US008016584B2

(12) United States Patent
Braungardt et al.

(10) Patent No.: US 8,016,584 B2
(45) Date of Patent: Sep. 13, 2011

(54) MOLD FOR THE PRODUCTION OF MOLDED CONCRETE BRICKS, AND MOLDED CONCRETE BRICK USING IT

(75) Inventors: Rudolf Braungardt, Gilching (DE); Holger Stichel, Lengenfeld/OT Pechtelsgrün (DE)

(73) Assignee: KOBRA Formen GmbH, Lengenfeld (DE)

( * ) Notice: Subject to any disclaimer, the term of this patent is extended or adjusted under 35 U.S.C. 154(b) by 673 days.

(21) Appl. No.: 12/154,992

(22) Filed: May 29, 2008

(65) Prior Publication Data

US 2008/0233335 A1 Sep. 25, 2008

Related U.S. Application Data

(63) Continuation-in-part of application No. PCT/EP2006/010987, filed on Nov. 16, 2006.

(30) Foreign Application Priority Data

Dec. 7, 2005 (DE) ..... 10 2005 058 404

(51) Int. Cl.
*B28B 7/16* (2006.01)

(52) U.S. Cl. ..... 425/255; 249/125; 249/184; 425/413; 425/416; 425/441; 425/468

(58) Field of Classification Search ..... 249/125, 249/142, 144, 176, 184, 185; 425/253, 254, 425/255, 338, 357, 358, 413, 416, 468
See application file for complete search history.

(56) References Cited

U.S. PATENT DOCUMENTS

| | | | | | |
|---|---|---|---|---|---|
| 789,996 | A | * | 5/1905 | McCullough | 249/172 |
| 793,055 | A | * | 6/1905 | Clough | 249/136 |
| 828,140 | A | * | 8/1906 | Robbins | 249/171 |
| 828,483 | A | * | 8/1906 | Keenan | 249/142 |
| 837,760 | A | * | 12/1906 | Whisler | 249/169 |
| 1,219,127 | A | * | 3/1917 | Marshall | 249/101 |
| 1,220,526 | A | * | 3/1917 | Marshall | 249/101 |
| 1,235,858 | A | * | 8/1917 | Tanner | 249/125 |

(Continued)

FOREIGN PATENT DOCUMENTS

DE 296 11 484 10/1996

(Continued)

OTHER PUBLICATIONS

International Search Report.

(Continued)

*Primary Examiner* — Yogendra Gupta
*Assistant Examiner* — Emmanuel S Luk
(74) *Attorney, Agent, or Firm* — Collard & Roe, P.C.

(57) ABSTRACT

A mold for the production of molded concrete bricks has mold recess bodies guided in openings in side walls of a mold insert, which openings are adapted to the contours of the recess bodies, in order to produce recesses in a molded concrete brick produced using this mold. The recesses reach all the way to the underside of a brick, and are supported on one or more sections of the edging of the opening. The wall thickness of the mold insert side wall can have a greater wall thickness in the region of the recess bodies. Preferably, the mold includes multiple mold inserts, and recess bodies that are similar in terms of position and movement direction are coupled mechanically with one another in their movement, and can be displaced together via common drive devices.

10 Claims, 6 Drawing Sheets

U.S. PATENT DOCUMENTS

| | | | | |
|---|---|---|---|---|
| 1,347,015 | A * | 7/1920 | Creason | 249/125 |
| 1,406,460 | A * | 2/1922 | Kinzinger | 249/129 |
| 1,685,188 | A * | 9/1928 | Beckwith | 249/125 |
| 2,283,968 | A * | 5/1942 | Bunch | 249/165 |
| 2,460,697 | A * | 2/1949 | Kreger | 249/66.1 |
| 2,498,923 | A * | 2/1950 | Jordan | 249/175 |
| 2,499,532 | A * | 3/1950 | Shearer | 249/91 |
| 2,550,977 | A * | 5/1951 | Dimock | 249/93 |
| 3,731,899 | A * | 5/1973 | Nuzzo | 249/142 |
| 4,218,206 | A * | 8/1980 | Mullins | 425/253 |
| 4,869,660 | A * | 9/1989 | Ruckstuhl | 425/195 |
| 5,358,214 | A * | 10/1994 | Batlle | 249/142 |
| 6,843,461 | B2 * | 1/2005 | Braungardt et al. | 249/63 |
| 7,175,414 | B2 * | 2/2007 | Ness et al. | 425/441 |
| 7,261,548 | B2 * | 8/2007 | Ness | 425/441 |
| 7,470,121 | B2 * | 12/2008 | Ness et al. | 425/195 |
| 7,575,217 | B2 * | 8/2009 | Jucha et al. | 249/130 |
| 2002/0125403 | A1 * | 9/2002 | Braungardt et al. | 249/176 |

FOREIGN PATENT DOCUMENTS

| | | |
|---|---|---|
| DE | 196 34 499 | 3/1998 |
| DE | 295 22 393 | 10/2002 |
| EP | 0 719 622 | 7/1996 |

OTHER PUBLICATIONS

A molded concrete brick is known under the designation HYDROVARIO (Spec, pp. 2-3).

* cited by examiner

Fig 10
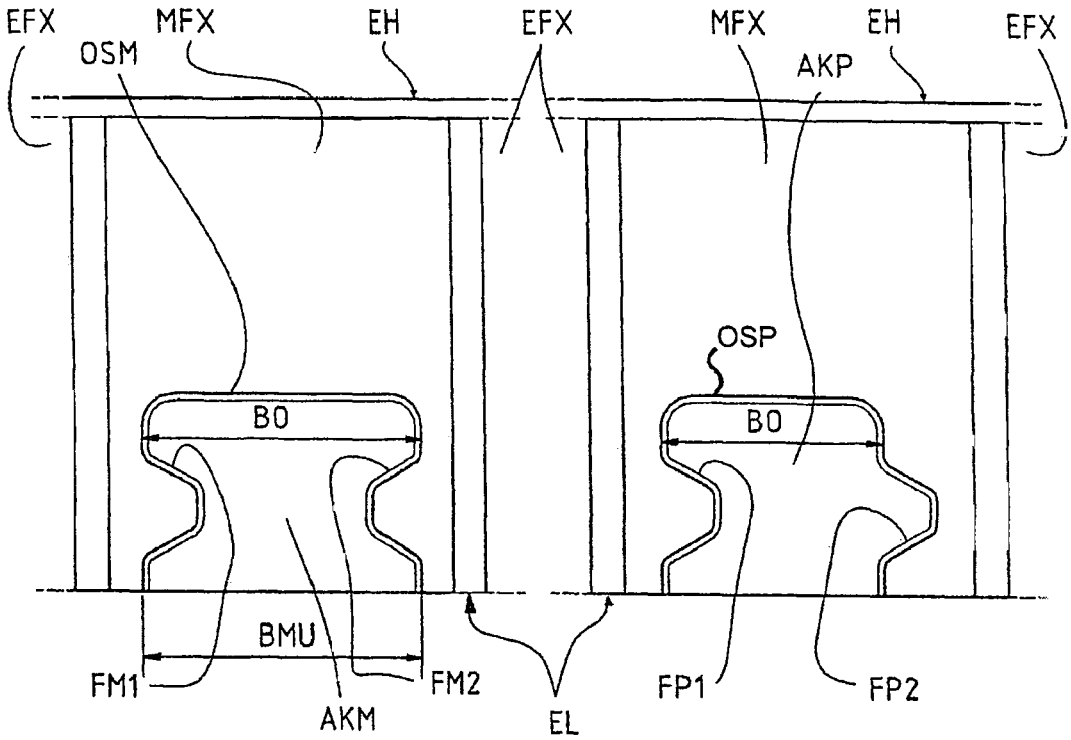
Fig 11
Fig 12
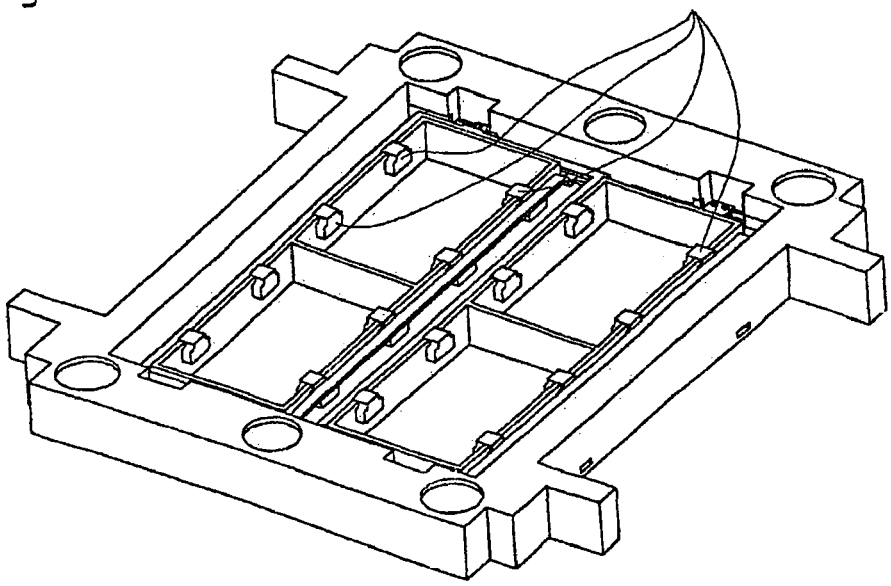

MOLD FOR THE PRODUCTION OF MOLDED CONCRETE BRICKS, AND MOLDED CONCRETE BRICK USING IT

CROSS REFERENCE TO RELATED APPLICATIONS

This application is a continuation-in-part and priority is claimed under 35 U.S.C. §120 of International Application No. PCT/EP2006/010987 filed Nov. 16, 2006, which claims priority from German Application No. 10 2005 058 404.7 filed Dec. 7, 2005.

BACKGROUND OF THE INVENTION

1. Field of the Invention

The present invention relates to a mold for the production of molded concrete bricks, and to a molded concrete brick produced using it.

2. The Prior Art

A molded concrete brick is known under the designation HYDROVARIO, which can particularly be used as a paving brick for larger areas, and is particularly advantageous for allowing rainwater to seep through the paved surface. In the HYDROVARIO paving brick, which is essentially rectangular, two side surfaces set opposite one another are offset toward the center of the brick, in a center region between corner regions. In this way, narrow slits are present in the paved surface at these locations. These side surfaces have recesses spaced apart from the top of the brick, which are open toward the outside and toward the underside of the brick. Rainwater can quickly drain into the recesses through the narrow slits, and from there seep into the ground underneath by way of the lower openings of the recesses, which are larger than the slits on the top of the brick.

Molds for the production of such molded concrete bricks contain recess bodies to produce the recesses, which bodies can be pushed into the mold insert parallel to the base, and pulled out of it again. It has been shown that the mechanism for displacement of the recess bodies is susceptible to failure.

SUMMARY OF THE INVENTION

It is an object of the invention to provide an improved mold for the production of molded concrete bricks, having a recess in at least one side surface. It is a further object to provide a molded concrete brick that can be produced using such a mold.

These and other objects are achieved, according to the invention, by a mold for the production of molded concrete bricks having at least one mold insert, in conventional manner, which insert has an upper opening in an upper delimitation plane and a lower opening in a lower delimitation plane. Essentially vertical side walls of the mold insert, which determine the shape of the molded concrete brick, run between upper and lower delimitation plane. The molded concrete bricks according to the present invention are approximately rectangular, in a preferred embodiment.

For the production of the molded concrete bricks, the mold is set onto a base, particularly onto a surface of a table or onto a board that lies on such a table, and pressed onto the base, so that the lower opening is closed. In operation, base and upper and lower delimitation plane run horizontally and parallel to one another. The information horizontal and vertical relates to the operating position of the mold. Wet concrete mixture is filled into the mold insert through the upper opening, which is still open. Afterwards, a pressure die is introduced into the upper opening, which die presses down onto the concrete mixture. The concrete mixture is compacted during a short vibration movement that acts on the concrete mixture, whereby preferably, a vibration device excites a vertical vibration movement of the table. After the vibration process, the mold is lifted off from the base, vertically relative to it, and the die is displaced all the way to the lower opening in the mold insert, relative to the mold. As this displacement happens, the compacted molded concrete brick is removed from the mold insert, in the downward direction.

For the production of the at least one recess in a side surface of the molded concrete brick, a recess body projects into the mold insert from a side wall of the mold insert. Before the wet concrete mixture is filled into the mold insert, the recess body is displaced into the mold insert in a first position, beyond the side wall. To remove the brick downward out of the mold insert, the recess body is displaced back out of the mold insert, into a second position in which it does not project into the mold insert beyond the side wall.

The displacement between the two positions preferably takes place as a linear displacement parallel to the lower delimitation plane qELr relative to the side wall, particularly in the direction of the surface normal lines of a planar section of the side wall.

The side wall has an opening in which the recess body is guided during displacement. The edging of the opening is adapted to the contour of the recess body and surrounds the recess body at a slight distance. Recess body and opening in the side wall of the mold insert reach all the way to the lower delimitation plane. In this way, the recess produced in the molded concrete brick moves all the way to the underside of the brick. Recess body and opening in the side wall of the mold insert are spaced so far away from the upper delimitation plane that the top of the molded concrete brick compacted in the mold insert lies higher than the highest point of the recess body.

It is essential to the present invention that the contour of the recess body and the edging of the opening in the side wall that is adapted to this body reach all the way to the lower delimitation plane and have at least one section, in their progression from the lower delimitation plane upward, in which the recess body lies above the edging of the opening that lies directly opposite it. Such a section can have both a horizontal progression and a progression inclined between horizontal and vertical. A horizontal progression, or a progression inclined by less than 30°, particularly less than 15°, relative to the horizontal, is particularly advantageous, because tolerances of a gap that exists for the horizontal displaceability of the recess body relative to the contour of the opening in the wall have a particularly slight effect on the vertical position of the recess body in this connection.

Via the aforementioned section, a force on the recess body directed in the direction of the base, particularly during the vibration process, at this section, is advantageously absorbed by the side wall of the mold insert.

It is advantageous if the recess body is mirror-symmetrical with regard to a vertical plane of symmetry. The forces on the recess body are then also symmetrical, and twisting moments are minimized.

In a first preferred embodiment, the width of the recess body, i.e. of the opening, is less at the lower delimitation plane of the mold than the greatest width that occurs at a position offset vertically upward from the underside. The section then advantageously lies at the transition from the lesser width to the greater width. It is advantageous if the width at the lower delimitation plane amounts to less than 60%, particularly less than 70% of the maximal width. The section preferably runs essentially horizontally. In another embodiment, the widening of the width of opening and recess body can also run in trapezoid shape, for example.

In another embodiment, the width of the recess body, i.e. of the opening, can also be reduced from an initially greater width at the lower delimitation plane, in the progression upward, at a distance from the lower delimitation plane, and afterwards widened again, or vice versa. The section can also be present at another progression of the edging of the recess body, i.e. opening. It is advantageous if such a section is present on both of the edging parts of the recess body, i.e. of the mold, that lead upward from the lower delimitation plane of the mold and lie opposite one another on the sides, in each instance.

It is advantageous if a region of the side wall of the mold insert that contains the opening and the recess body is offset toward the center of the mold insert, to a slight degree, as compared with a corner region of the same side wall. For one thing, this offset of the region of the side wall in this region results in a greater wall thickness of the side wall of the mold insert. Therefore this offset results in improved guidance and support of the recess body in the opening of the side wall. For another thing, gaps are formed in a pavement surface, through which water can drain from the top of the pavement surface into the recesses in the side surfaces of the bricks.

It is advantageous if at least one opening having a recess body is present, in each instance, in two side walls of the mold insert that lie opposite one another.

In an advantageous embodiment, a mold contains multiple similar mold inserts having at least one recess body, preferably at least one recess body in two sides that lie opposite one another, in each instance. Recess bodies that correspond to one another in terms of positioning in the mold inserts, in each instance, and in terms of movement direction, are advantageously coupled with one another mechanically, outside of the mold inserts.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views:

FIG. 10 shows an alternative example for a contour of a recess body and opening in the side wall;

FIG. 11 shows another example for a contour of recess body and opening in a side wall; and FIG. 12 shows an embodiment with multiple recess bodies, in each instance, in side walls of the mold inserts.

DETAILED DESCRIPTION OF PREFERRED EMBODIMENTS

Figure 1:
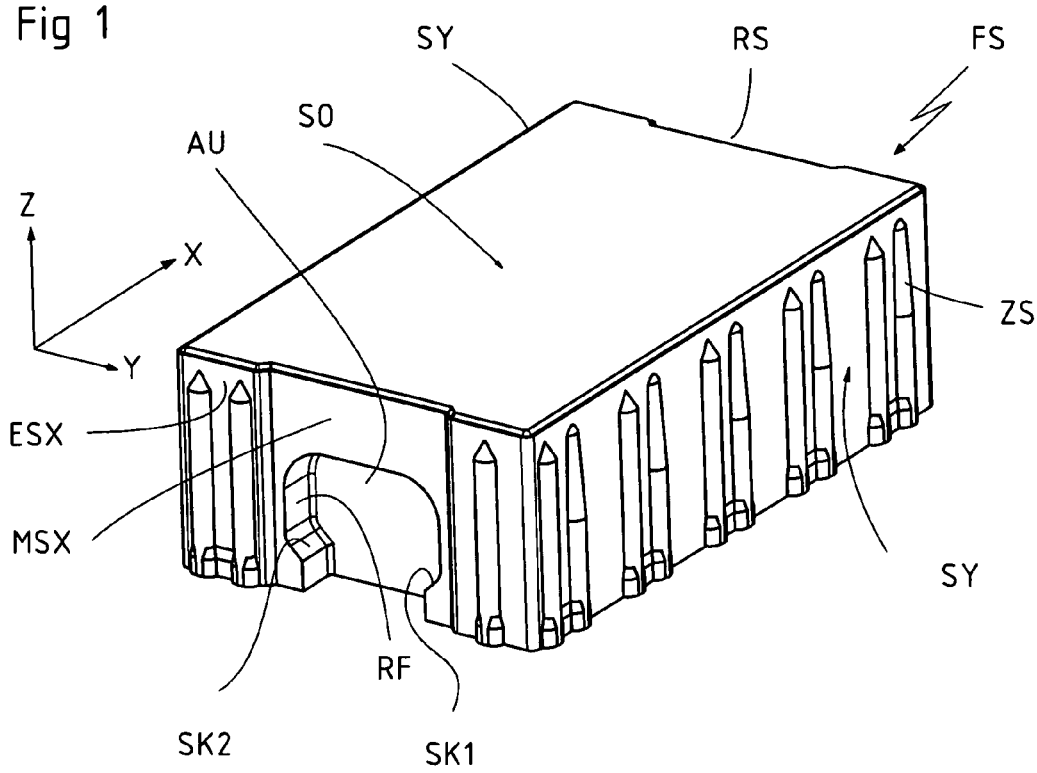
FIG. 1 shows a molded concrete brick at a slant from above.
Figure 2:
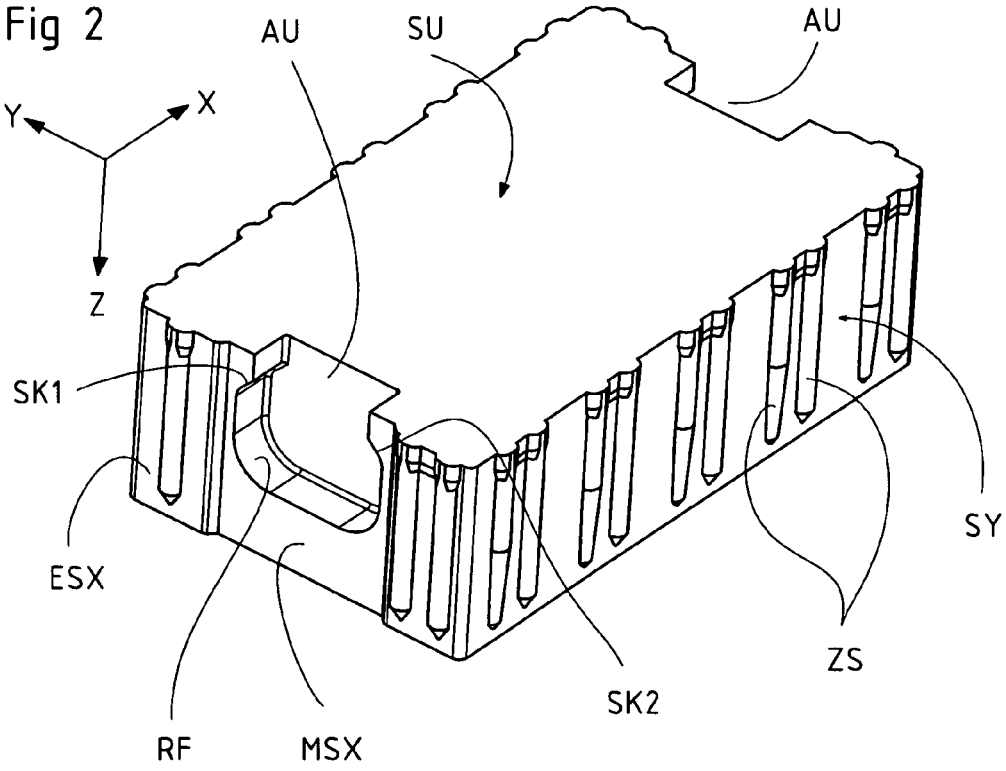
FIG. 2 shows the molded concrete brick according to FIG. 1 at a slant from below.

Referring now in detail to the drawings, FIG. 1 shows in a slanted view from above a particularly advantageous embodiment of a molded concrete brick FS, and FIG. 2 shows this embodiment in a slanted view from below. This embodiment also illustrates characteristics of the mold, according to the invention, for the production of such molded concrete bricks. In FIG. 1 and the subsequent figures, a right-angle x-y-z coordinate system is also drawn in, for a comparison orientation. In this connection, x and y are coordinates in a horizontal plane, and z is the vertical coordinate. The information relates to the orientation of the brick in the mold and in its regular position in a paved surface.

The molded concrete brick shown in a slanted view from above in FIG. 1 is particularly advantageous as a paving brick and has an approximately rectangular shape of its upper surface (top) SO. The brick is delimited on the sides by side surfaces SY, the surface normal lines of which run parallel to the y direction. In the x direction, the brick is delimited on the side by means of a stepped surface having partial surfaces ESX in the region of the corners of the brick and a partial surface MSX between such corner regions. The partial surface MSX is offset toward the direction of the center of the brick by a slight amount, as compared with the partial surfaces ESX. At the side surfaces, alignment structures ZS are produced, which project beyond the planes of the surfaces SY, ESX, and which engage into one another when the bricks are joined together and secure adjacent stones in their reciprocal position in a surface. The alignment structures ZS reach all the way to the lower surface (underside) SU of the stone that can be seen in FIG. 2, but are preferably at a distance from the upper surface SO of the brick with their upper ends. When such similar bricks are joined together in a surface, the offset of the partial surface MSX relative to the corner region partial surfaces ESX brings about the formation of a widened gap RS between adjacent bricks.

The contour of the upper surface SO of the brick determines the appearance of the brick in a surface paved with similar bricks. The side surfaces SY, ESX, MSX continue the contour of the upper surface SO essentially vertically downward, whereby the vertical surfaces are interrupted by the alignment structures ZS and a recess AU in the region of the partial surface MSX. In the following, however, unless explicitly stated otherwise, the side surfaces are understood to be the vertical surfaces that result from vertical continuation of the edging of the upper surface SO downward, without taking into consideration the alignment structures and recesses.

The recess AU in the partial surface MSX, i.e. in two partial surfaces MSX that are set opposite one another in the x direction, reaches all the way to the underside SU of the brick and is thereby open downward to a substratum on which the brick is laid. The width of the recess in the y direction is less, on the underside of the brick, than a maximal width in a region spaced upward, i.e. in the z direction, from the underside of the brick. A transition from the lesser width to the maximal width is formed by means of sections SK1, SK2 of the edge surface RF of the recess that are inclined relative to the vertical. At these sections SK1, SK2, the edge surface of the recess points more or less strongly upward, depending on the size of the angle relative to the vertical. It is advantageous if the edge surface in these sections is inclined by at least 45° relative to the vertical z direction (i.e. the surface normal line inclined relative to the horizontal y direction). In this connection, the edge surface of the recess AU is understood to be the surface that delimits the recess in the y and z direction. The recess is spaced apart from the top SO of the brick and thereby closed off toward the top. The recess AU is open parallel to the x direction, pointing outward from the center of the brick. The delimitation surface of the recess AU toward the center of the brick is preferably parallel to the partial surface MSX.

Figure 3:
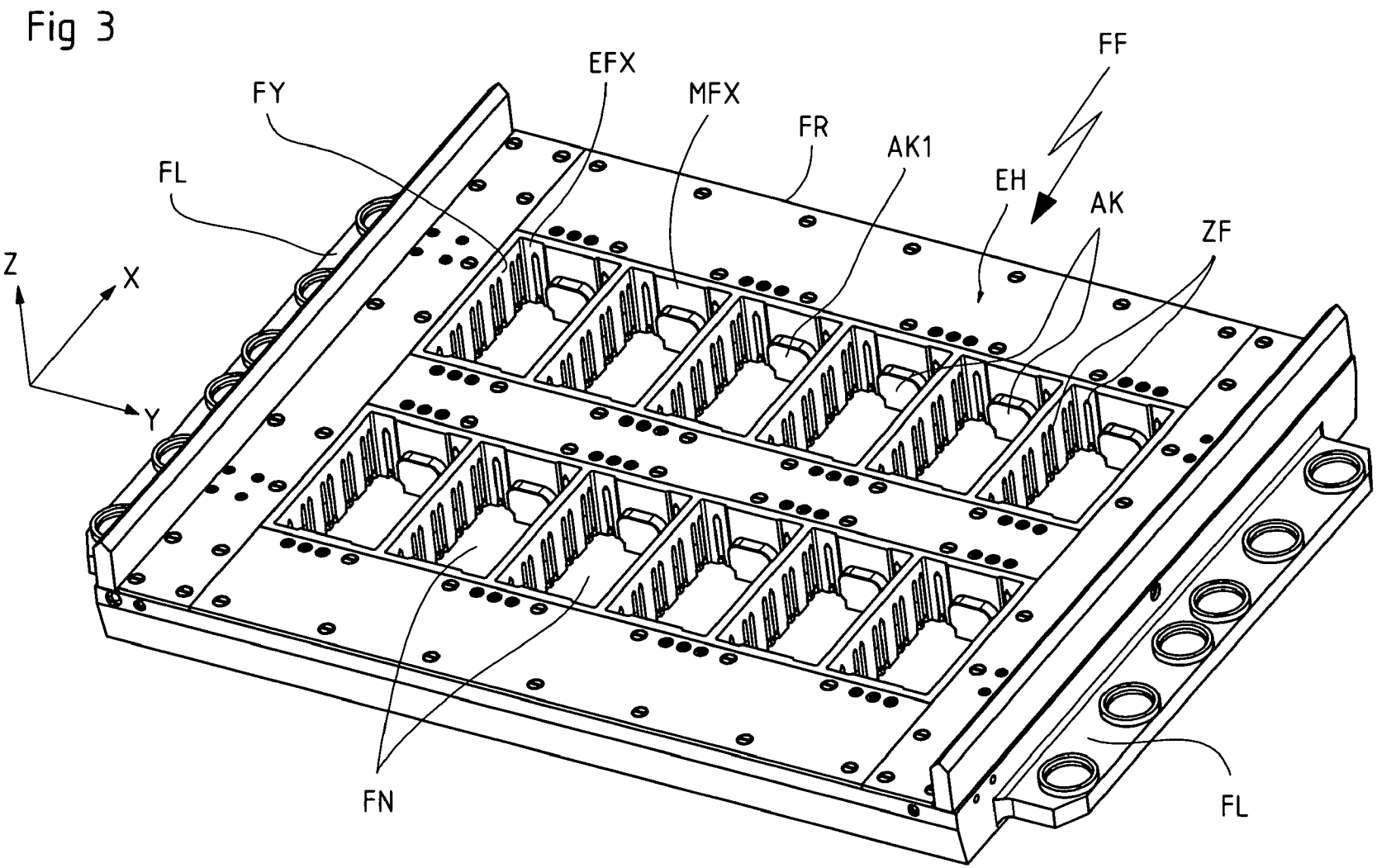
FIG. 3 shows a mold having multiple mold inserts, at a slant from above.

FIG. 3 shows an advantageous embodiment of a mold for the production of molded concrete bricks of the type shown in FIG. 1 and FIG. 2. The mold FF is shown in a slanted view from above.

The mold FF contains a mold frame FR, in conventional manner, from which frame two flanges FL project on opposite sides, and a multiplicity of mold inserts FN surrounded by the mold frame FR.

Figure 4:
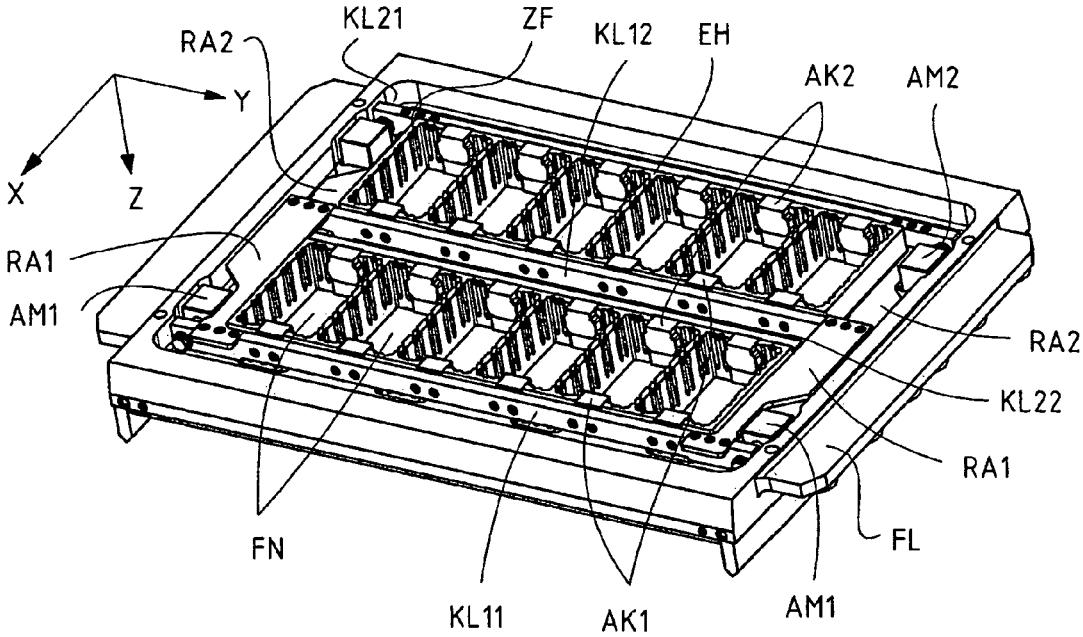
FIG. 4 is a side view of the mold according to FIG. 3 at a slant from below.

The mold inserts FN are delimited on the sides by means of mold insert walls FY having surface normal lines in the y direction, and by means of partial surfaces EFX, MFX having surface normal lines essentially parallel to the x direction. The mold insert walls form side wall surfaces that run vertically, i.e. essentially in the z direction, between an upper opening in an upper delimitation plane EH and a lower opening in a lower delimitation plane EL. Recess bodies AK1 that project into the mold inserts, against the partial surfaces MFX, in the position shown in FIG. 3 and FIG. 4, are disposed, in each instance, in the partial surfaces MFX of the side walls of the mold inserts that lie opposite one another in the x direction. Recess bodies are disposed in the two side walls of the mold nests that lie opposite one another in the x direction, in each instance.

In the view according to FIG. 4, the undersides of all the recess bodies can be seen, whereby in FIG. 4, two groups of recess bodies are designed as being different, by means of AK1 and AK2. In this connection, the recess bodies AK1 are all disposed on the side walls of the mold inserts that lie opposite one another in the x direction, and the recess bodies AK2 are all disposed on the side walls of the mold inserts FN that lie opposite one another in the x direction. The recess bodies AK1, AK2 reach all the way to the lower delimitation plane EL of the mold and thus all the way to the lower edges of the partial surfaces MFX of the side walls of the mold inserts.

The recess bodies are fitted into openings of the side walls, i.e. of the partial surfaces MFX of the side walls, and guided to be displaceable in these, in the x direction. In this connection, the recess bodies AK1, AK2 and the openings in the side walls of the mold inserts adapted to their contour have a lesser width in the y direction, in a y-z section plane at the lower delimitation plane EL, than in a position spaced apart from the lower delimitation plane in the direction of the upper delimitation plane, in the z direction. Transition sections between the lesser width and the greater width can advantageously serve for vertical support of the recess bodies in the openings of the side walls.

The recess bodies AK1, AK2 are displaceable in the x direction in the openings of the side walls that serve at least partially as guides. It is advantageous if the recess bodies that are situated at the corresponding position of multiple mold inserts adjacent to one another in the y direction and following one another are mechanically coupled with one another, for which purpose strips KL11, KL12, KL21, and KL22 that particularly run outside of the mold inserts in the y direction are provided, to which the recess bodies are attached, particularly screwed on. All the recess bodies that lie in the corresponding position are connected with one another by way of the strips, and can advantageously be displaced together, in each instance, parallel to the x direction, by means of drive devices AM1, AM2.

It is advantageous in the case of multiple rows of mold inserts, two in the case of the example shown, which run in the y direction and are offset relative to one another in the x direction, if the recess bodies of the two rows of mold inserts situated in corresponding positions are again connected with one another, for which purpose the strips KL11 and KL12 are connected with one another to form frames by way of frame segments RA1, and the strips KL21 and KL22 are connected with one another to form frames by way of frame segments RA2, in each instance. The frame formed by frame segments RA1 and strips KL11, KL12 is displaceable by means of drive devices AM1, the frame formed by frame segments RA2 and strips KL21, KL22 is displaceable by means of drive devices AM2, parallel to the x direction, in each instance. Thus, all the recess bodies are collectively displaceable in simple and advantageous manner, by means of these two frames. The drive devices AM1 can be driven electrically, pneumatically, or hydraulically, for example.

Figure 5:
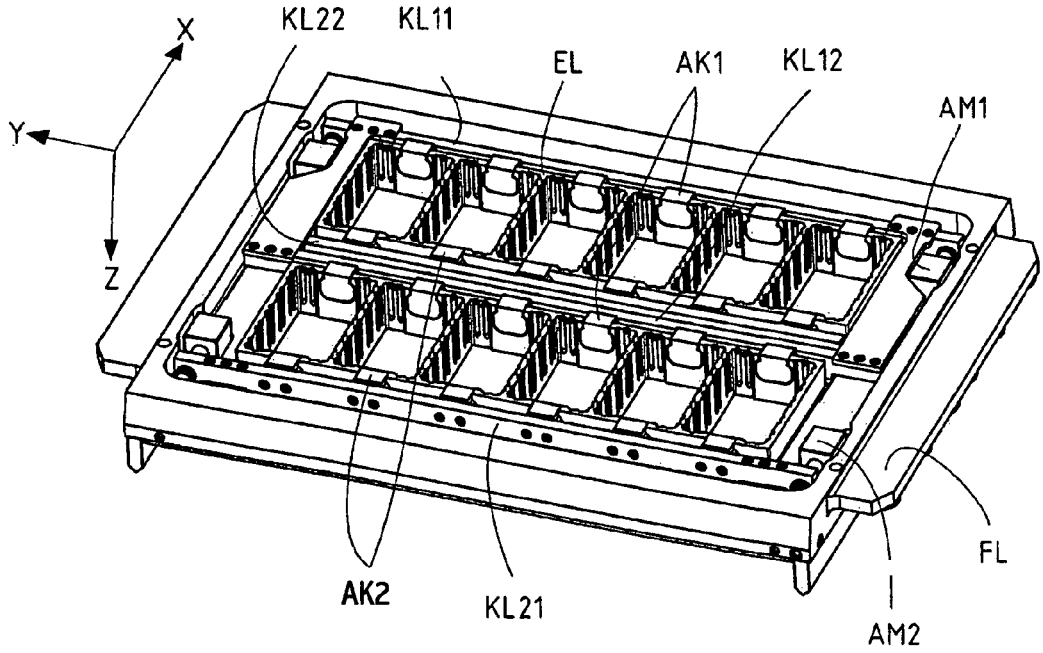
FIG. 5 shows the mold according to FIG. 4 with recess bodies retracted from the mold inserts.

While FIG. 3 and FIG. 4 show the mold with a position of the recess bodies in which these project beyond the partial surfaces MFX of the side walls of the mold inserts into the mold inserts, FIG. 5 shows the mold with the recess bodies in a position in which the recess bodies do not project into the mold inserts, and the surfaces of the recess bodies that face the mold inserts advantageously run flush with the surface regions MFX. In FIG. 5, the mold is furthermore shown in a view rotated by 180° about the z axis, as compared with FIG. 4, in order to show the symmetrical configuration of the mold. In FIG. 3 to FIG. 5, depressions ZF for producing the alignment structures ZS (FIGS. 1-2) at the side surfaces of the molded brick can be seen.

Figure 6:
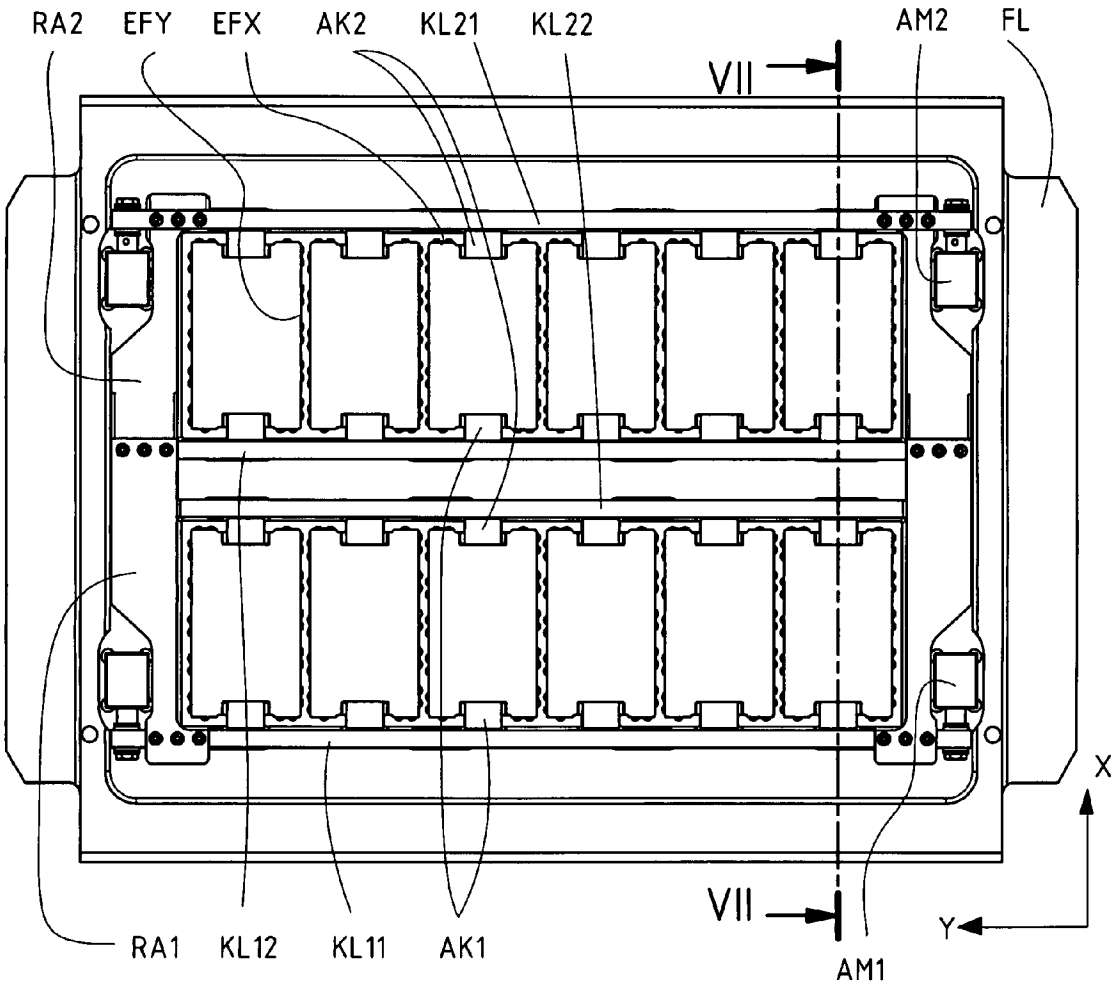
FIG. 6 shows the mold according to FIG. 4 with a vertical viewing direction, from below.

FIG. 6 shows the mold in the position of the recess bodies as in FIG. 4, in a view with a vertical viewing direction onto the lower delimitation plane of the mold, i.e. the underside of the mold frame. FIG. 6 shows partial surface EFY having a surface normal line generally parallel to the y direction. Aside from the properties already described, it can also be seen in FIG. 6 that according to an advantageous embodiment, the wall thickness of the side walls is greater in the region of the recess bodies than on both sides of them, at the corner regions of the mold inserts.

Figure 7:
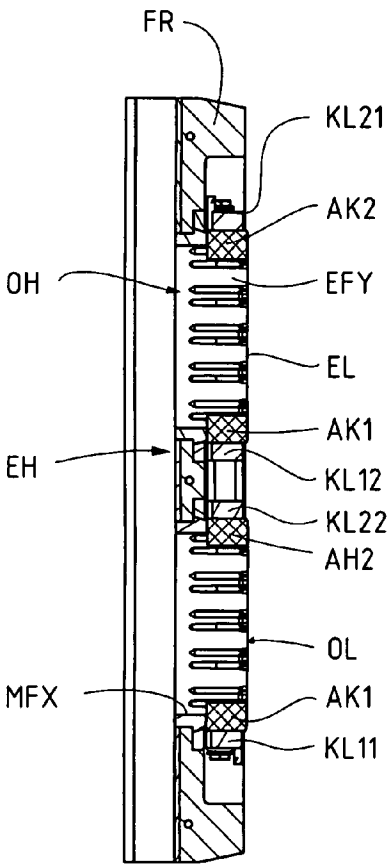
FIG. 7 shows a section VII-VII through FIG. 6.

FIG. 7 shows a sectional view along the section plane VII-VII of FIG. 6. The recess bodies AK1, AK2, which reach all the way to the lower delimitation plane EL and are spaced vertically apart from the upper delimitation plane EH, project into the mold inserts. The upper openings of the mold inserts are designated as OH, the lower openings as OL.

Figure 8:
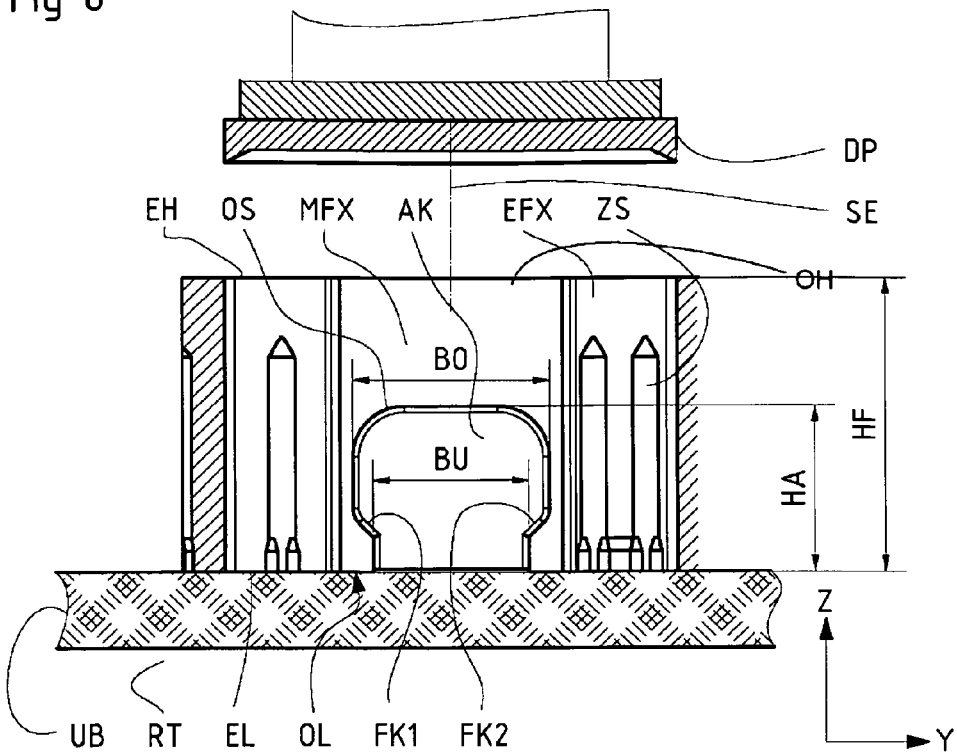
FIG. 8 is a top view of a side wall of a mold insert.

FIG. 8 shows a view within a mold insert onto a side wall that lies in the x direction. A recess body AK is fitted into an opening OS of a partial surface MFX of the side wall, as indicated by the double line. In a real case, the outside contour of the recess body AK and the inside contour of the opening OS lie only fractions of a millimeter apart from one another, so that the dimensions of the contours of recess body AK and opening OS can be viewed as being the same.

Recess body and opening, respectively, have an initial lower width BU at the lower delimitation plane EL, which widens to a greater width BO in the case of the continuing progression of the contour of recess body AK and opening OS, in the z direction, in sections FK1, FK2, which width, in the example shown, is, at the same time, the maximal width of the recess body and the opening, respectively.

It is advantageous if the lesser lower width BU of the recess amounts to at least 50%, particularly at least 60%, preferably at least 70% of the greater width BO. The lesser width BU is advantageously at least 10% less than BO. At the sections FK1, FK2, corresponding to the edging sections SK1, SK2 of the recesses AU (FIGS. 1-2) of the brick, the recess body AK, i.e. its edging lies vertically above the edging of the opening OS, which lies directly opposite it. In the case of forces on the recess body AK directed vertically downward, particularly during the vibration process, the recess body AK can therefore advantageously support itself in these sections FK1, FK2 on the contour of the opening OS. The sections FK1, FK2 preferably run essentially horizontally. On the initial vertical sections of the edgings of recess body and opening, which run vertically upward, and in the region of the maximal width BO, the edging of the recess body lies to the side of the edging of the opening; at the upper end of recess body and opening, the edging of the recess body lies below the edging of the opening, which lies directly opposite. In the preferred embodiment according to FIG. 8, recess bodies AK and openings OS are mirror-symmetrical with regard to a vertical x-z plane SE as the mirror plane. The height HA of the recess body over the lower delimitation plane EL advantageously amounts to between 40% and 90% of the height HF of the mold insert FN between the delimitation planes EL, EH. The height of the finished molded concrete brick is less as compared with HA, since the concrete mixture is compacted.

In FIG. 8, it is also indicated that the mold can be set onto a base UB, particularly a board on a vibration table RT, with the lower delimitation plane EL, whereby the lower openings OL of the mold inserts are closed off by the base UB. Wet concrete mixture can be filled into the mold inserts by way of the upper openings OH of the mold inserts in the upper delimitation plane EH. A pressure plate DP of a die assembly is introduced into the upper openings OH of the mold insert, which plate is pressed onto the upper surface of the concrete mixture during a vibration process, and is indicated in FIG. 8 above the mold insert. To unmold the compacted and solidified molded concrete bricks from the mold inserts, the mold is raised from the position shown in FIG. 8, with the pressure plate of the die assembly resting on the top surface of the molded concrete brick, relative to the base UB and relative to the pressure plate that is fixed in place relative to the base UB in this phase, whereby the pressure plate gets all the way into the region of the lower delimitation plane EL, i.e. the lower openings OL of the mold insert. Afterwards, the pressure plate of the die assembly is raised again. After removal of the molded concrete bricks and insertion of a board as a base UB, the mold is lowered to the base again and pressed down against it, and again filled with wet concrete.

Figure 9:
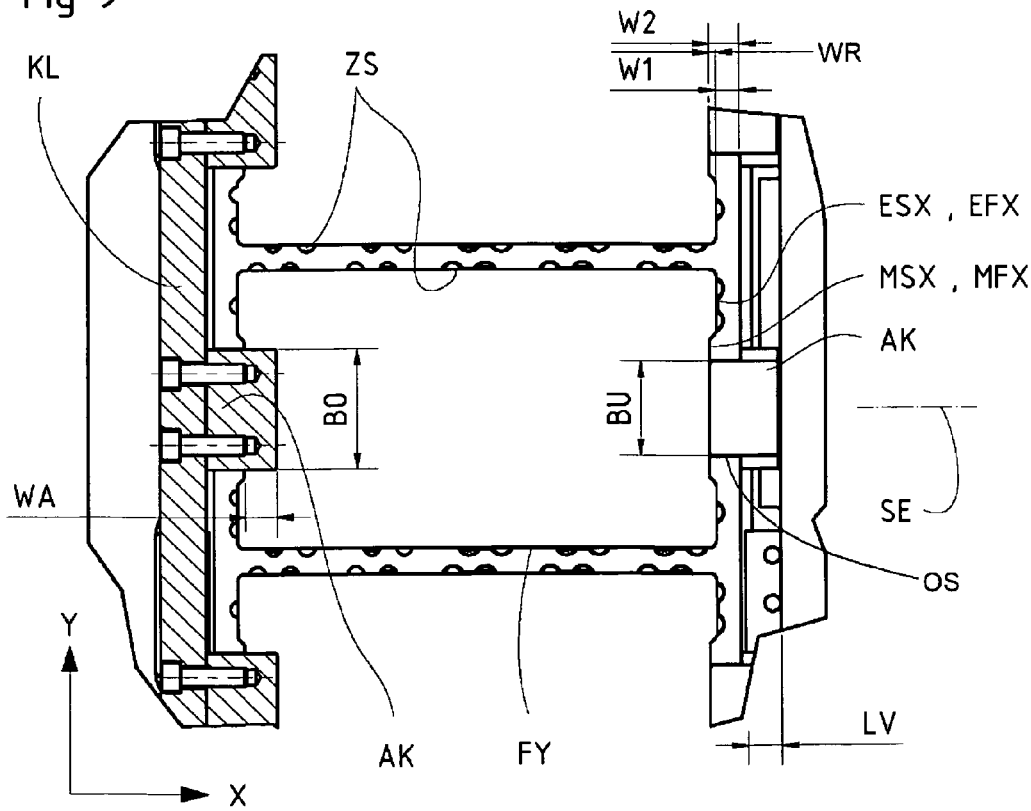
FIG. 9 is a side view of the underside of a molded brick in a mold insert.

FIG. 9 shows a side view of a molded concrete brick in a mold insert, with a side view of the base, from below. In this connection, the position of the recess bodies AK assumed during compacting of the concrete mixture is shown in the left half of FIG. 9, and the retracted position of the recess bodies AK required for unmolding is shown in the right half of FIG. 9. In the left half of FIG. 9, the recess body AK and the strip KL that carries it are shown cut in a section plane parallel to the base, whereby this section plane runs at the height of the maximal width BO of the recess body. The right half of FIG. 9 is a side view from below of the lower delimitation plane of the mold.

The depth of the recesses AU relative to the surface sections MSX is designated as WA. The depth WA is advantageously greater than the offset WR of the partial surfaces MSX and MFX, respectively, relative to the partial surfaces ESX, EFX in the partial surfaces adjacent to the center partial surfaces MSX, MFX. The depth WA of the recesses AU is advantageously greater than the offset WR of the partial areas relative to one another. The thickness of the mold insert is designated with W1 in the corner regions having partial surfaces ESX, EFX, and with W2 in the center region with partial surfaces MSX, MFX, whereby W2=W1+WR. The displacement path LV of the recess bodies AK is essentially equal to the depth WA of the recesses AU in the brick, and equal to the difference between the first and the second position of the recess bodies. The expanse of the recess body AK in the x direction, i.e. essentially in the direction of the center partial surface MFX of the side wall of the mold insert, which is assumed to be planar, is at least equal to the sum of the wall thickness W1 and the depth WA of the recess. In the side view according to FIG. 9, the alignment structures with relative lateral offset can also be seen, whereby such a lateral offset and the engagement of the centering structures of adjacent bricks can take place with a different relative arrangement in the x direction than in the y direction of adjacent bricks.

FIG. 10, in a representation analogous to FIG. 8, shows a contour of recess bodies AKM and adapted opening OSM in the side wall of the mold insert, whereby in this case, the initial lower width BMU is equal to the maximal width of the recess in the y direction, and supporting sections FM1, FM2 are present at a narrowing of the recess in a position spaced apart from the lower delimitation plane EL.

FIG. 11 shows another example, for illustrating the general applicability, in which the recess possesses a constant width in its vertical progression, but does not run in linear manner, and supporting sections FP1, FP2 in the contour of a recess body AKP and an adapted opening OSP lie on opposite sides, not at the same height.

FIG. 12 shows another example of a mold in a slanted view, in which the mold inserts in themselves are larger, and two recess bodies spaced apart from one another in the y direction are displaceable in corresponding openings of the side wall, on sides that lie opposite one another in the x direction, in each instance. In this example, the wall thickness of the side wall is not increased in the region of the recess bodies.

The characteristics indicated above and in the claims, as well as evident from the figures, can advantageously be implemented both individually and in various combinations. The invention is not limited to the exemplary embodiments described, but rather can be modified in many ways, within the scope of the skills of a person skilled in the art.

Thus, although only a few embodiments of the present invention have been shown and described, it is to be understood that many changes and modifications may be made thereunto without departing from the spirit and scope of the invention as defined in the appended claims.

What is claimed is:

1. A mold for producing molded concrete bricks comprising:

(a) at least one mold insert comprising an upper opening on an upper horizontal delimitation plane, a lower opening on a lower delimitation plane, a plurality of side walls running substantially vertically between said upper opening and said lower opening, the side walls substantially determining a contour of a molded concrete brick (b) at least one recess body displaceable relative to a side wall of the plurality of sidewalls and guided in a side wall opening of said side wall, said at least one recess body having a shape and said side wall opening being adapted to said shape, said at least one recess body being displaceable between a first position wherein said at least one recess body projects beyond said side wall into said at least one mold insert and a second position wherein said at least one recess body does not project into said at least one mold insert, said at least one recess body and said side wall opening extending to reach the lower delimitation plane and being spaced from the upper delimitation plane, the side wall opening having edging extending below said at least one recess body in at least one section and said at least one recess body being vertically supported on said at least one section.

2. The mold according to claim 1, wherein the side wall opening has a side wall opening width and of the at least one recess body has a recess body width, said widths increasing from an initial width at the lower delimitation plane upward to a greater width.

3. The mold according to claim 1, wherein the side wall opening and the at least one recess body are symmetrical to a vertical mirror plane.

4. The mold according to claim 1, wherein the at least one recess body has a recess body height and the at least one mold insert has a mold insert height, the recess body height from the lower delimitation plane toward the upper delimitation plane amounting to between 40% and 90% of the mold insert height.

5. The mold according to claim 1, wherein said at least one recess body comprises an adaptation body and the side wall has a partial surface offset in a direction toward a center of the at least one mold insert near the adaptation body, relative to partial surfaces of adjacent corner regions.

6. The mold according to claim 5, wherein the offset has an offset dimension smaller than a difference between the first position and the second position of the adaptation body.

7. The mold according to claim 1, wherein the at least one recess body is guided to be displaceable in a linear manner.

8. The mold according to claim 1, further comprising a pressure plate displaceable vertically relative to the at least one mold insert, between above the upper opening and the lower opening.

9. The mold according to claim 1, wherein said at least one recess body comprises at least first and second recess bodies disposed respectively on two side walls that lie opposite one another.

10. The mold according to claim 1, wherein a plurality of mold inserts are disposed in at least two parallel rows, and wherein a plurality of recess bodies for mold inserts of the at least two parallel rows are attached on at least one common frame and are displaceable.

* * * * *